US007048333B2

(12) United States Patent
Martinez

(10) Patent No.: US 7,048,333 B2
(45) Date of Patent: May 23, 2006

(54) COLLAPSIBLE SUN SHADE FOR A CHAIR

(76) Inventor: Robert E. Martinez, 16 Indian Hill La., Laguna Hills, CA (US) 92653

( * ) Notice: Subject to any disclaimer, the term of this patent is extended or adjusted under 35 U.S.C. 154(b) by 0 days.

(21) Appl. No.: 10/139,692

(22) Filed: May 3, 2002

(65) Prior Publication Data

US 2003/0106577 A1 Jun. 12, 2003

Related U.S. Application Data

(60) Provisional application No. 60/357,674, filed on Dec. 12, 2001.

(51) Int. Cl.
*A47C 7/66* (2006.01)

(52) U.S. Cl. ..... 297/184.11; 297/184.15; 135/96; 135/126

(58) Field of Classification Search ..... 135/96, 135/125, 126, 136, 93, 33.7; 5/418; 297/184.1, 297/184.11, 184.15, 184.13; 224/155
See application file for complete search history.

(56) References Cited

U.S. PATENT DOCUMENTS 1,502,666 A * 7/1924 Grady
2,109,881 A * 3/1938 Goldberg
3,075,536 A * 1/1963 Parker ..... 135/87
3,241,160 A * 3/1966 Escobar
3,380,370 A * 4/1968 Mack ..... 454/275
3,456,661 A * 7/1969 Farley ..... 135/33.7
4,030,748 A * 6/1977 Brock
4,082,102 A * 4/1978 Heuer
4,687,249 A * 8/1987 Mills
4,804,008 A * 2/1989 Ryder et al. ..... 135/33.7
4,825,892 A * 5/1989 Norman
4,858,634 A * 8/1989 McLeese
4,865,380 A * 9/1989 Heitzman-Powell et al. ..... 297/184.13
4,865,381 A * 9/1989 Van Rogue
4,898,085 A * 2/1990 Jarnot ..... 454/275
4,951,333 A * 8/1990 Kaiser et al.
5,033,528 A * 7/1991 Volcani
5,116,273 A * 5/1992 Chan
5,135,281 A * 8/1992 Pappalardo
5,139,308 A * 8/1992 Ziman
5,301,999 A * 4/1994 Thompson et al.
5,397,268 A * 3/1995 Chang et al. ..... 454/338
5,481,767 A * 1/1996 Lewis
5,582,458 A * 12/1996 Wildt
5,593,205 A * 1/1997 Vanderminden, Sr. et al.
5,638,849 A * 6/1997 Scott
5,678,586 A * 10/1997 Baksh ..... 135/33.7
5,693,398 A * 12/1997 Granger
5,758,889 A * 6/1998 Ledakis ..... 280/47.38
D400,949 S * 11/1998 Gale ..... D21/253
D412,354 S * 7/1999 Takos ..... D21/837

(Continued)

FOREIGN PATENT DOCUMENTS

WO WO 00/42276 * 7/2000

*Primary Examiner*—Robert Canfield
(74) *Attorney, Agent, or Firm*—Philip H. Haymond

(57) ABSTRACT

A collapsible sun shade adapted to be used with a chair is disclosed. The shade is made of spring steel or equivalent material and is adapted to be affixed to cover the seat portion of a lounge chair. The shade is unfolded under the force of the compressed spring and attached to the chair to provide shade over the seat of the chair.

31 Claims, 7 Drawing Sheets

U.S. PATENT DOCUMENTS 5,951,103 A * 9/1999 Barnhill
5,967,601 A * 10/1999 Gillins
5,992,045 A * 11/1999 Kellogg et al. ..... 34/442
6,095,599 A * 8/2000 Lambert
6,173,725 B1 * 1/2001 Garth
6,293,292 B1 * 9/2001 Watzke
6,305,396 B1 * 10/2001 Zheng ..... 135/126
6,595,227 B1 * 7/2003 Le Gette et al. ..... 135/126
6,698,827 B1 * 3/2004 Le Gette et al. ..... 297/16.2
RE38,591 E * 9/2004 Kellogg et al. ..... 34/442

* cited by examiner

COLLAPSIBLE SUN SHADE FOR A CHAIR

This application cites and applicants hereby claim the priority of the filing date of U.S. provisional patent application Ser. No. 60/357,674, filed Dec. 12, 2001, which is hereby incorporated herein by reference.

BACKGROUND OF THE INVENTION

1. Field of the Invention

This invention relates to sun shade apparatus to be used with a chair. More particularly this invention relates to a system of a collapsible sun shade for use with collapsible recreational chairs.

2. Description of Related Art

Many people enjoy camping, frequenting the beach, sporting events and other outdoor locals to spend their leisure time, sunbathing in lounge chairs while reading, socializing or just relaxing. People have varying degrees of tolerance to the potentially harmful rays of the sun however and many individuals prefer to avoid direct sunlight altogether even though they enjoy the outdoors. The face, neck and arms are exposed to the sun while lounging outdoors which may produce skin cancer and premature wrinkling.

Many people try to protect their skin while lying in the sun so various devices and assemblies have been developed for providing shade to sunbathers. Most notably, umbrellas are still widely used by beachgoers, homeowners, and commercial establishments such as restaurants, hotels and resorts, to provide protection and comfort from the sun's intense rays. Others have proposed various canopy and sunshade structures which mount to outdoor chairs. For example, many resorts provide lounge chairs with cabana style canopies that have a domed configuration extending up from the back of the chair and surrounding the back rest and the sides, top and rear of the chair. While this type of structure can be effective in providing shade, these style chairs may be difficult to transport and assemble in remote areas where the person must first hike, bringing the chair with them.

With the widespread interest in the outdoors users may also want to first hike to remote areas before enjoying the scenery, such as to a remote beach. Chairs, shades and other items must be first carried to the remote location and therefore space and weight are at a premium because it is difficult to take chairs, shades, ice chests and other comforts over distances. It is even more difficult to take these items separately and assemble them to work together at the remote location.

What is needed then is a fully collapsible chair and sunshade assembly that may be easily transported. It is desirable to have a sun shade that removably attaches to the chair, where the sunshade assembly can be fully collapsed, is easy to pack in an integral unit, is easy to assemble with few moving parts and has a canopy that can be adjusted through a range of operable positions to thereby offer a full range of sun protection.

SUMMARY OF THE INVENTION

A sun shade system is provided that includes a sun shade adapted to be used with a chair. The shade is a collapsible shade that is collapsed under spring tension and may be moved to from an open position to a closed position for storage under spring tension. The shade is adapted to be affixed to chair to cover a at least a portion of the seat of the chair and thus a user occupying the seat portion of the chair.

A typical collapsible lounge chair may be used in conjunction with the collapsible shade. The shade may be adapted to be affixed to the chair in many ways. Where the chair has a back rest portion the shade may be bent over the back rest portion and held over the seat with one or more cords that are affixed to the chair. Bending the shade is to twist, fold or otherwise torque the shade to increase the spring tension in the ring, from that tension the ring has in the fully open position. The cords may additionally be cinched to the chair to provide for the comfort of the user.

In this system the chair may be equipped with straps to allow it to be transported as a backpack and the shade may be conveniently stored therein. The chair may be further equipped with storage for an ice chest or other items, as well as a spritzer atomization bottle for keeping the user cool. The invention further includes methods for using the disclosed system.

DETAILED DESCRIPTION

The following detailed description, and the figures to which it refers, are provided for the purpose of describing example(s) and specific embodiment(s) of the invention only and are not intended to exhaustively describe all possible examples and embodiments of the invention. In the following various figures identical elements and features are given the same reference number, and similar or corresponding elements and features are or may be given the same reference numbers followed by an a, b, c, and so on as appropriate for purposes of describing the various embodiments of the present invention.

In one broad aspect the problem of providing adequate shade for a chair is solved by using a shade comprised of a hoop or ring of spring steel or other spring material that has fabric or more generally a membrane stretched across the hoop. The hoop may be compressed by folding or coiling it into a closed or collapsed position for convenient storage and transported together with a chair, such as a lounge chair. When the chair and shade are assembled the hoop is first allowed to expand to an open position from the force of the compressed ring, allowing the compressed spring to uncoil. The shade is then affixed to the chair in a manner that will allow at least a portion of the chair to be covered by the shade.

Figure 1A:
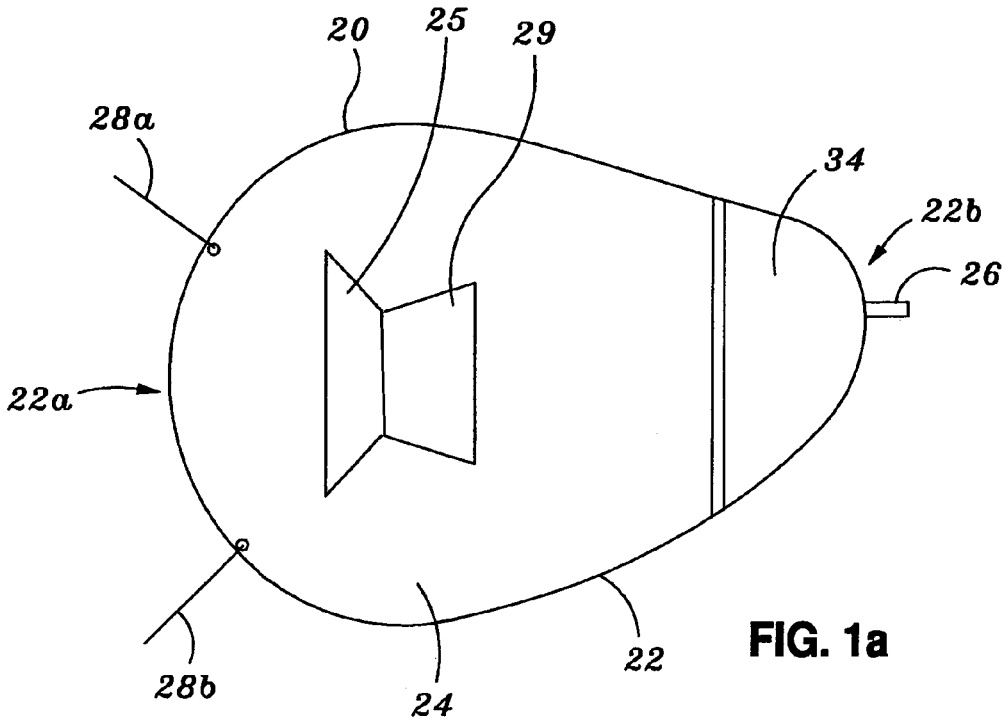
FIGS. 1*a*–*b* are front views of exemplary shades of the present invention.
Figure 1B:
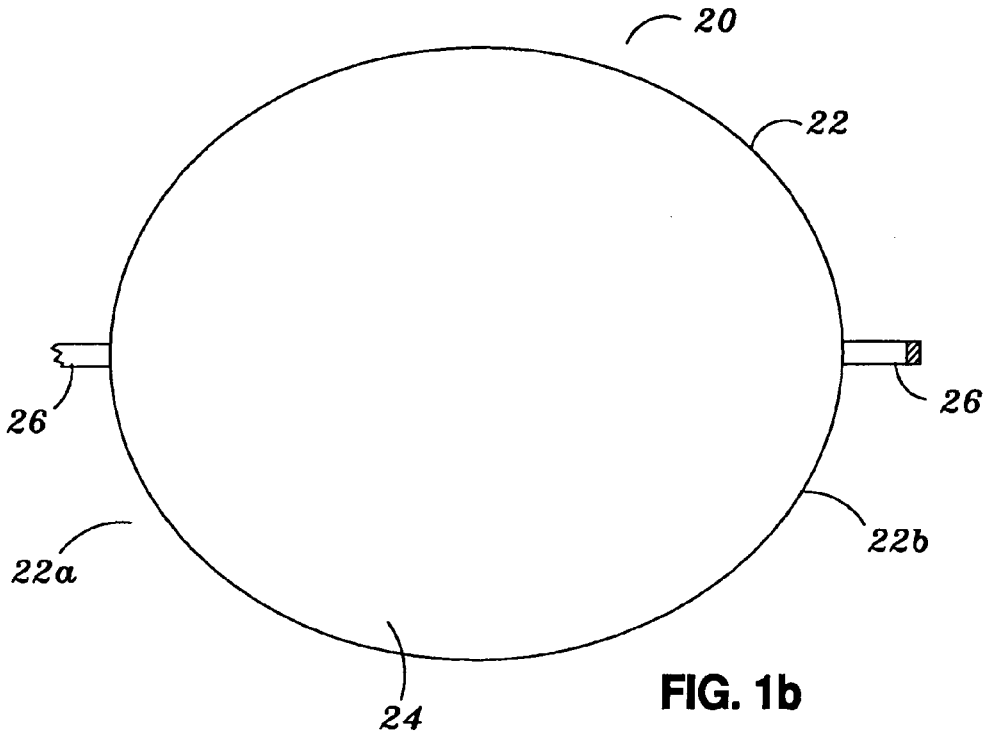

Referring now to FIGS. 1*a* and 1*b*, embodiments of the a sun shade of the present invention are disclosed. A collapsible shade 20 adapted to be affixed to a chair is provided. The chair may be of any type but includes at least a seat portion. In the preferred embodiment, below, a lounge chair having a back rest and left and right arm rests is used. The shade 20 is comprised of a ring 22 having a front end 22*a* and a rear end 22*b*, and is made from flexible rod material such as plastic, fiberglass or stainless steel that is tensioned to form the ring. A membrane or fabric, 24 is attached to the ring, in the preferred embodiment by hemming the ring in its entirety of the perimeter so that the fabric substantially encloses the area within the ring. In a first, open position, shown in FIGS. 1*a* and 1*b* the fabric 24 is preferably tensioned within the ring 22. In the embodiments shown the ring 22 is generally elliptical but, although the preferred shape of the ring 22 is elliptical it will be apparent to those skilled in the art that the invention is equally applicable to circular, rectangular, oval, or polygonal geometries.

In the preferred embodiment, shown in FIG. 1*a*, the ring is elliptical but wider at the front end 22*a* than it is at the back end 22*b* to allow the narrower back end 22*b* to be more contoured to the width of the back rest portion of a chair when it is bent over the back rest portion, as shown below. The wider front end 22*a* accordingly provides wider shade coverage over the seat portion of the chair. The elliptical shade shown in FIG. 1*b* is adapted to be affixed to a chair in a another manner that does not include bending the shade over a back rest of the chair, but of bending over the seat portion.

The membrane or fabric 24 may be any of a large number of materials such as nylon, polyester, rayon, acrylic, wool, cotton or neoprene as desired. The preferred material is a woven fabric such as cotton or cotton-polyester. In the preferred embodiment the fabric is made from a slightly open weave or fine mesh to reduce wind resistance, but could be made from other fabrics, if need be, such as waterproof fabric to act as an umbrella against the rain. A flap or screen 29 is preferably incorporated into the fabric 24 to further allow wind to pass through the shade. The flap 29 may be of any type, for example a square piece of fabric that is partially sewn over an opening in the fabric 24 on one side or less than all sides of the square, thereby allowing air to pass between the fabric and the square. Alternatively a fine mesh screen, also shown as 29, may be incorporated into the fabric 24; a detachable cover (not shown) may be fashioned for the screen, for example a square piece of fabric that attaches to the fabric 24 with hook and loop fasteners may be used to cover the screen. In the preferred embodiment the fabric 24 of the side of the shade 20 intended to be placed towards the sky when in use, is finished with a reflective or shiny surface so as to reflect sunlight and keep the user cool.

The ring 22 comprises flexible spring steel in the preferred embodiment. Although any suitable material, such as plastic or rubber, could be used for the ring 22, spring steel is preferred because it is not only reliable and less expensive, but its added weight helps hold the shade in place against the force of wind. The thickness of the ring 22 is chosen to provide the right balance of characteristics allowing easy collapsing of the ring but also providing spring forces adequate to cause the shade to open and respond to the desired folding forces in the proper manner. Flattened spring steel wire is preferred for the ring although rod wire is stronger because the flattened wire is less massive and therefore safer to open. It has been found that a ring 22 made of flattened steel wire is also easier to open than one of steel rod wire.

The shade in the closed or collapsed position is metastable or unstable because the potential energy of the tensioned ring in the closed position will cause the ring 22 to naturally expand back to the open positions of FIGS. 1*a* an 1*b* unless the ring is retained in the closed position. The shade may be conveniently stored when it is in the closed position by placing it within a carrying bag or by banding (not shown) placed about it to retain the shade in the closed position. The ring material therefore must be substantially flexible but not deformable so that it can be folded to reflexively open to its open position shape, having been under tension after when coiled to the closed position.

The use of fabric-covered collapsible hoops is known in the art for other applications. Kaiser, et. al, U.S. Pat. No. 4,951,333; Norman, U.S. Pat. No. 4,825,892 and McLeese, U.S. Pat. No. 4,858,634 generally disclose the use of this technology. The selection for a particular chair of proper fabric materials and of proper spring material to make the ring, as well as methods of folding or collapsing such collapsible hoops will therefore be readily apparent to those of skill in the art and requires no further discussion.

The sun shade 20 of the present invention is further adapted to be bent over the seat portion of a chair when it is in the open position. In one embodiment, shown in FIG. 1*a*, this is achieved by using one or more cords, in the preferred embodiment left cord 28*a* and right cord 28*b*, affixed to the front end of the shade 22*a*. The shade 20 further may optionally have a clip 26, shown in FIG. 1*a* to affix to the rear of the chair. FIG. 1*b* shows an embodiment of the shade 20 that is adapted to be affixed to a chair with clips 26 at each end 22*a* and 22*b*.

Figure 2A:
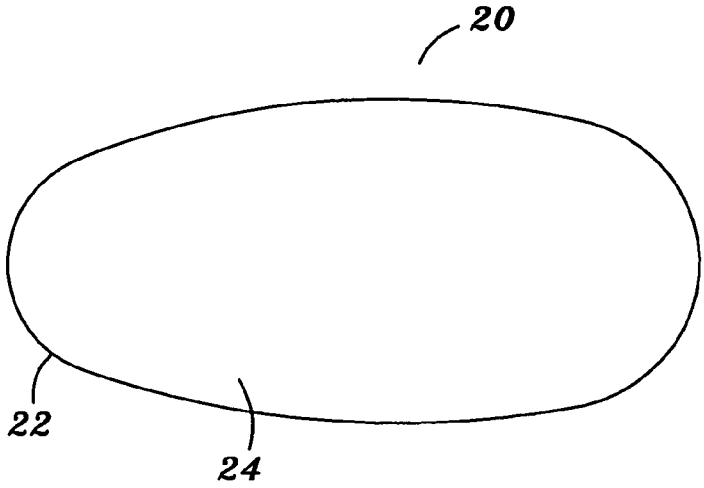
FIGS. 2*a*–2*d* are a series of views of the shade of the present invention being moved from an open position to a closed or collapsed position.
Figure 2B:
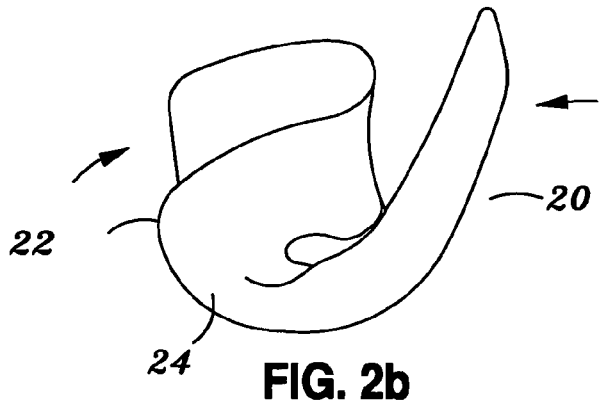
Figure 2C:
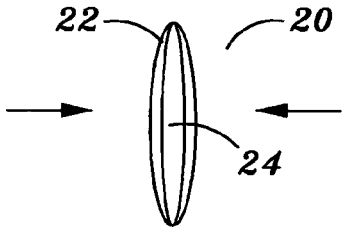
Figure 2D:
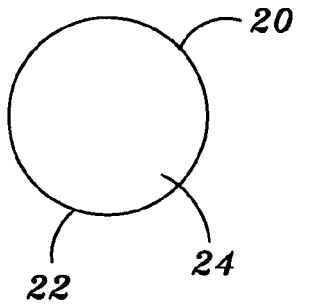

FIGS. 2*a*–2*d* show an example of a shade 20, here the embodiment of FIG. 1*a*, being folded from the open position of FIG. 1*a* or 1*b* to form a smaller more compact shape of a second, collapsed position of the shade, shown in FIGS. 2*c* and as a side view in 2*d*. The shade 20 of 2*a* is twisted into loops as shown in 2*b* and 2*c* and pushed into the closed position shown in 2*c* and 2*d* in the direction indicated by arrows. Releasing the loops causes the ring 22 of the shade 20 to expand to the open position under its own stored spring forces to the shape of FIG. 1*a* or 1*b*.

Figure 3A:
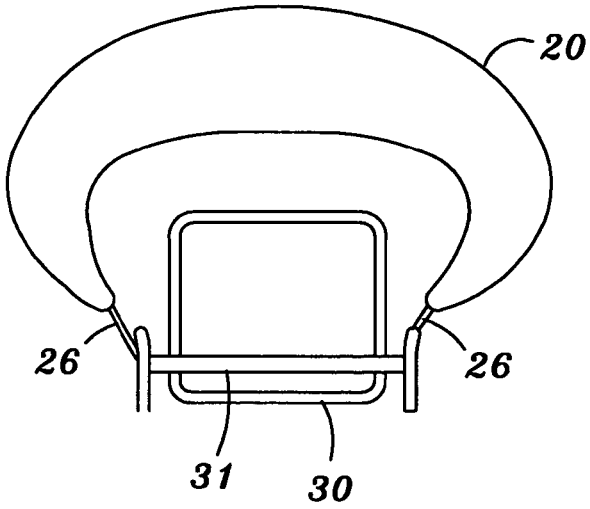
FIGS. 3*a*–3*d* are front and side perspective views of two embodiments of the present invention.
Figure 3B:
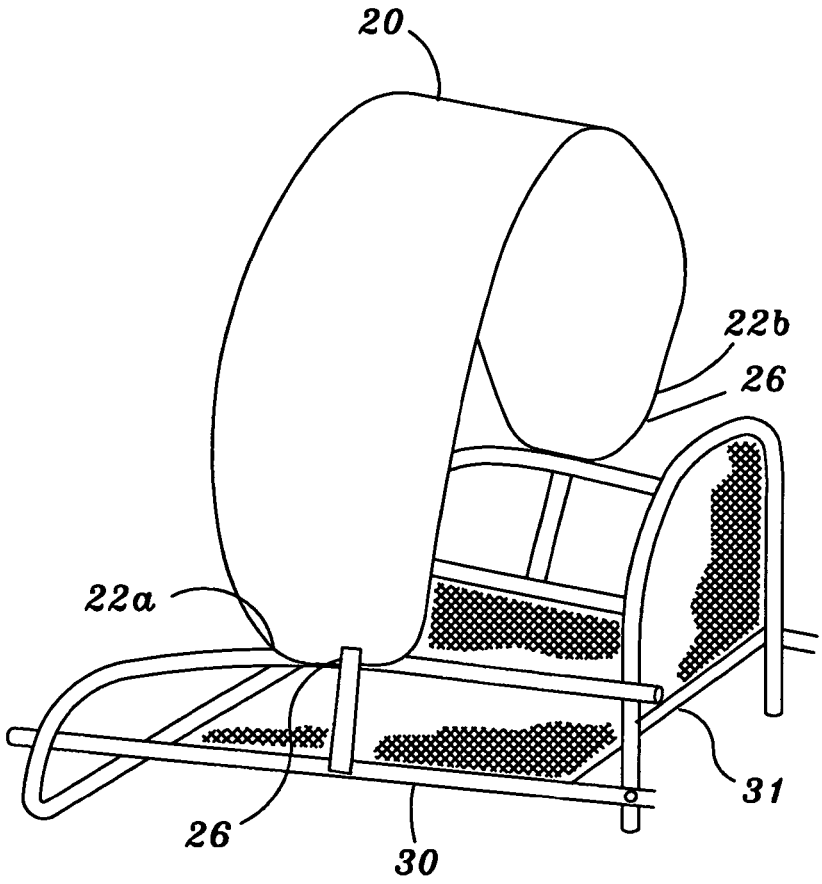
Figure 3C:
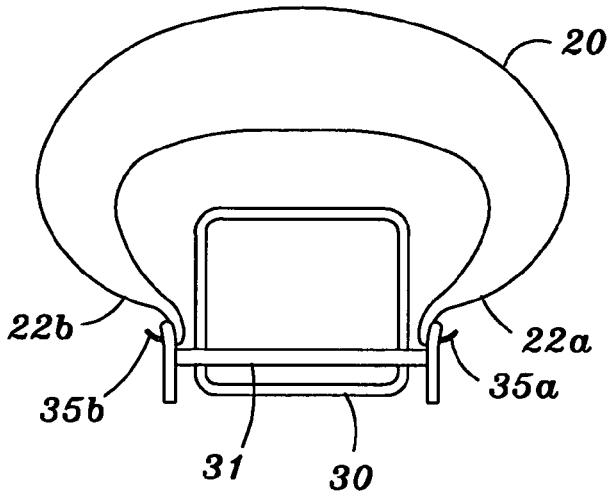
Figure 3D:
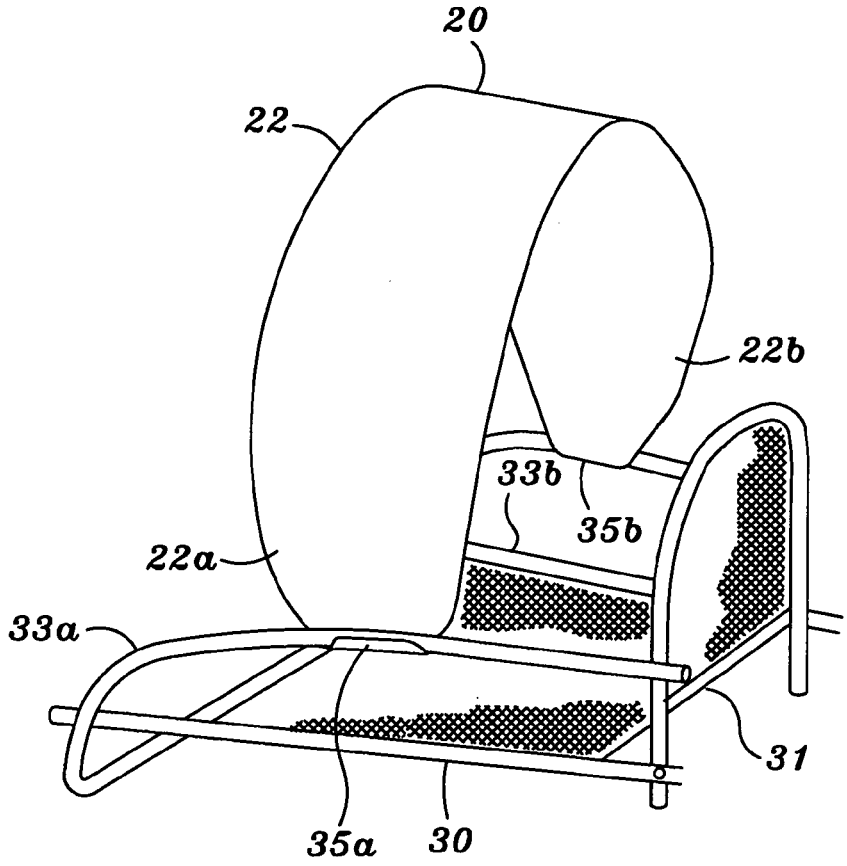

Referring now to FIGS. 3*a* and 3*b* in a broad aspect the present invention encompasses a collapsible sun shade 20 adapted to be affixed to a chair 30 having a seat portion 31. The shade 20 may be affixed to a chair 30 at the seat portion or other portion in any number of ways such that it covers the seat portion, for example in this embodiment bowing or otherwise extending the shade over sides of the seat portion 31. In this example the shade 20 of FIG. 1*b* is affixed to either side of the chair 30 with the clips 26 shade ends 22*a* and 22*b*, but any releasable fasteners may be used, strings or cords for example. It is envisioned adapting the shade 20 to be affixed to a chair 30 may be accomplished in a number of ways. For example the ring 22 may be adapted to be affixed to a particular chair without the use of cords, clips or other fasteners by forming the ring itself in such a shape to it cooperate with a given chair to affix the shade to the chair. For example, FIGS. 3*c* and 3*d* show the sun shade 20 adapted to be affixed to a chair 30 having a seat portion 31. The shade 20 may shown here is affixed to a chair 30 at the arm rests 33*a* and 33*b*, the ring 22 at shade ends 22*a* and 22*b* is shaped to form hooked ends 35*a* and 35*b*, which are hooked under the arm rests such that it covers the seat portion.

Figure 4:
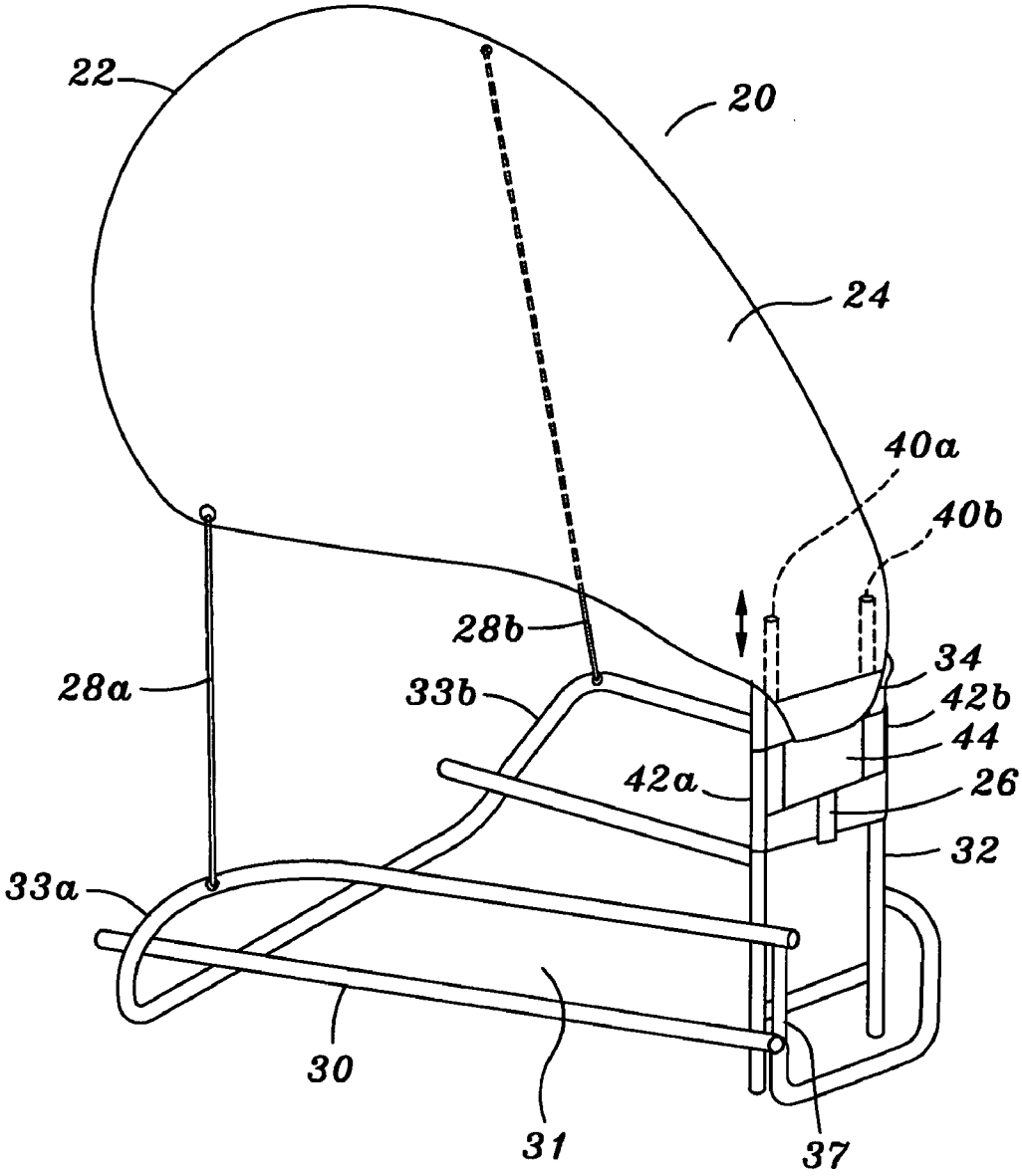
FIG. 4 is a rear perspective view of a preferred system of the present invention, showing the shade of the present invention and a lounge chair, both in the open positions.
Figure 4A:
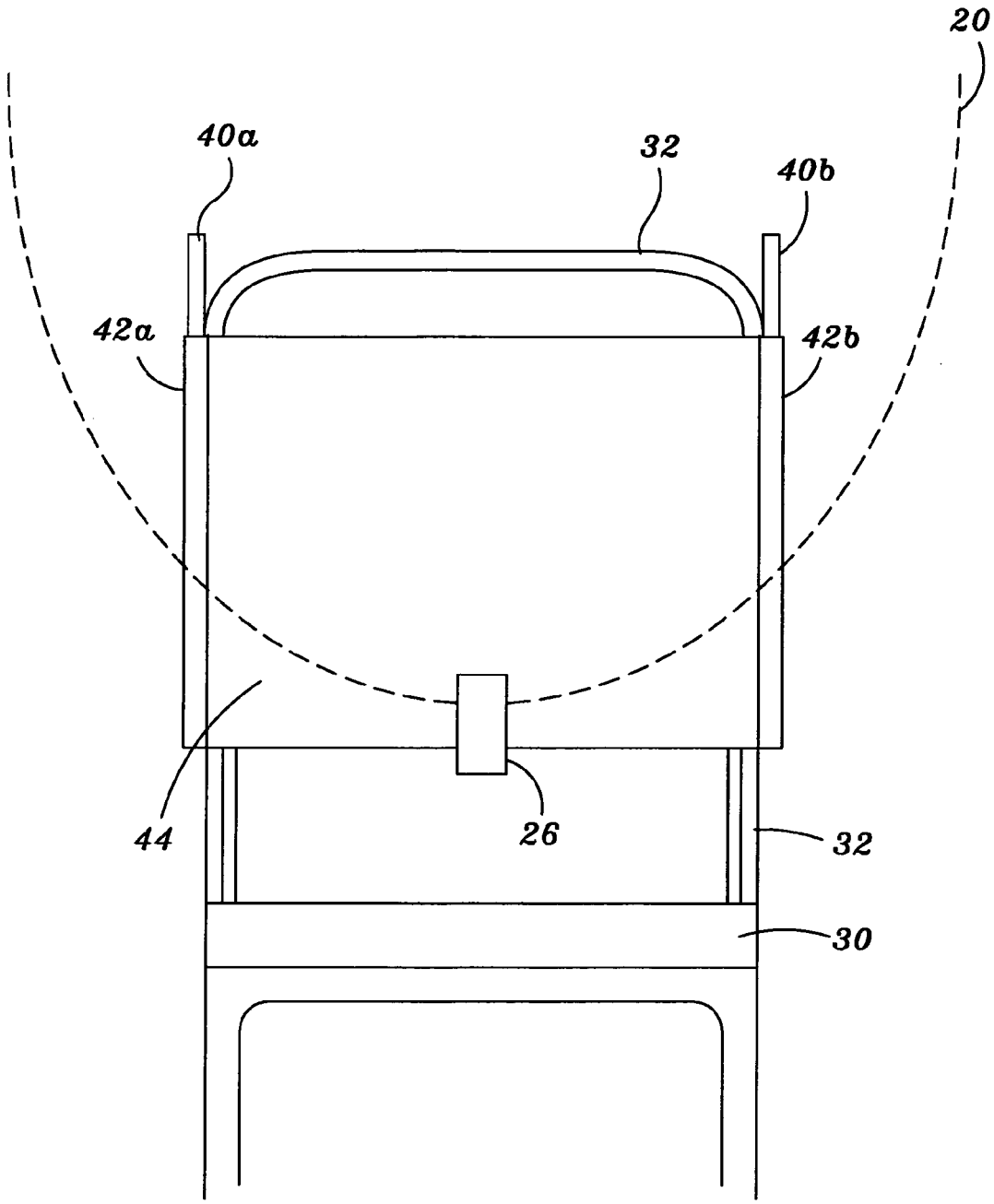
FIG. 4*a* is a detail view of an alternative embodiment of the support band of the present invention.

Referring now to FIG. 4, a preferred embodiment a shade system is shown. A chair 30 having seat 31 and back rest 32 portions is used with the collapsible shade of FIG. 1*a*. In the preferred embodiment the system of the present invention is used with a widely-available collapsible lounge chair, made of tubing and fabric and having seat 31 and back rest 32 portions that are adjustably attached by hinges 37 allowing the chair to be hingeably folded to a first, folded or closed compact position and unfolded to a second open position, as shown in FIGS. 3 and 4. Such recreational lounge chairs having two such positionable configurations are known by those of skill in the art and do not require further description. Both the shade 20 and the chair 30 are shown in their open positions and the shade 20 is affixed to the chair 30 for use. Some chairs and those of the preferred embodiment further have left and right arm rests, 33*a* and 33*b;* in the preferred embodiment chairs are used having the arm rests integrally formed from the tubing used to form the chair 30.

In this embodiment the clip 26 is passed between a support band 44 of fabric sewn across the side of the back rest 32 (also shown in FIG. 5) distal the seat 31, between the back rest 32 and the support band 44. The rear end of the shade 22*b* is partially passed under the support band, the clip is releasably attached to the lower portion of the back rest 32. The support band 44 aids in keeping the shade 20 centered over the back rest 32. The clip 26 may also be adapted to be affixed to the back rest 32 itself. In the preferred embodiment the support band 44 may be sewn directly onto the back rest as shown. The support band can also act as a storage compartment, when the shade 20 is in the closed position it may be conveniently stored between the support band 44 and the back rest 32.

The support band 44 may alternatively be provided as a loop of a band of fabric that may be fitted around the back rest 32 of an existing chair 30, as shown in FIG. 4*d*. The loop 44 fits over the backsides and front of the backrest 32. The support band 44 may have clip 26 to anchor the shade 20 (shown in dotted lines) to the support band. In this embodiment it is preferred to incorporated elastic material into the support band 44 so that fitting the support band 44 over the back rest 32 will stretch the elastic material and so act to affix the support band 44 to back rest 32. Sleeves 42*a* and 42*b* are provided to hold extending support poles 40*a* and 40*b*.

The support band 44 alone may therefore function to affix the shade, holding the rear end of the shade against the back rest with the support band itself being affixed to the chair. This embodiment can be used with any chair having a back rest and the inventor envisions that the term chair will be construed broadly, to include for example a wheelchair, a boat chair, a kayak chair. This embodiment may be used with virtually any chair having a back rest.

The ring at the narrow end of the shade 22*b* is more contoured to the width of the back rest 32 portion of the chair 30, which aids in placing the shade 20 under the support band 44, and the front end 22*a* of the ring of the shade 20 is generally wider to provide wider shade coverage over the seat portion of the chair. A fabric pocket 34 (also shown in FIG. 1*a*) may be additionally sewn on the shade so that in use it will be located on the side distal the back rest 32, to allow for the storage of small items such as keys.

After affixing the rear end of the ring 22*b* of the shade, one or more cords, shown here as 28*a* and 28*b* (partially in dotted lines), are then attached to the chair and cinched to draw or bend the shade over the chair. Each cord is attached to an arm rest, 33*a* and 33*b* and, in this bent position, the tension of the ring 22 of the shade 20 maintains the shape of the shade 20.

In most cases, however, it is desirable to also raise the rear end 22*b* portion of the bent shade upwardly to prevent the curving shade from engaging a user's head as he sits in the chair. In the preferred embodiment an elevating support is provided that is adjustable in length and is affixed to the back rest of the chair extending upwardly from the top of the back rest, whereby when the shade is bent over the back rest the elevating support will raise the rear portion of the shade higher than the height of the back rest. In the preferred embodiment, as shown in FIG. 4, the extending support is comprised of extending support left pole 40*a* and right pole 40*b* (shown partially as dotted lines) that are held in sleeves 42*a* and 42*b* sewn into the support band. The extending support poles 40*a* and 40*b* may be raised or lowered (indicated by arrow) by the user as desired to elevate or lower the rear arc of the bent shade to avoid the users head and upper torso.

Figure 5:
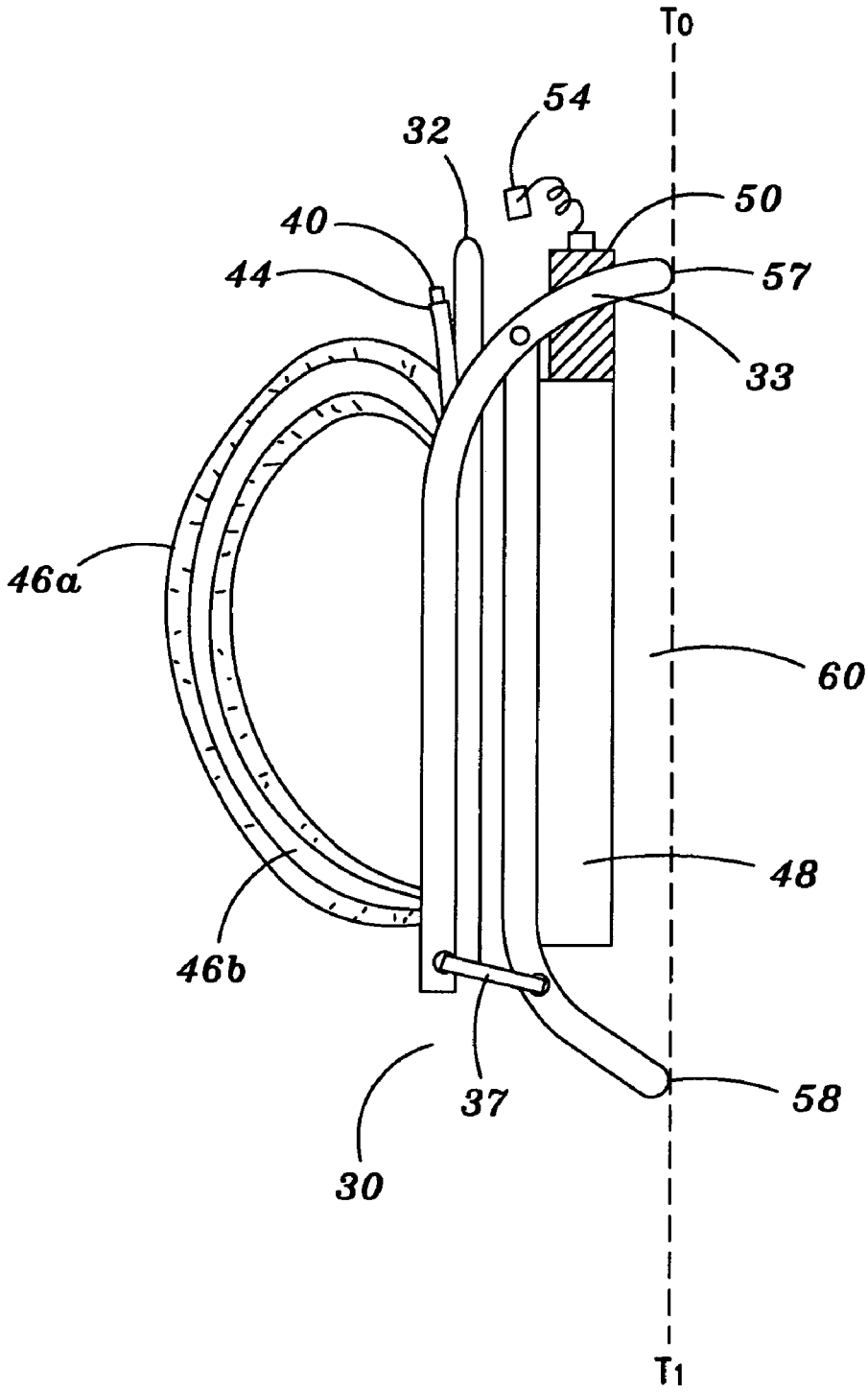
FIG. 5 is a side elevation view of the system of the present invention showing the shade of the present invention stored with chair in the closed position.

Referring now to FIG. 5, the system is shown in a stored configuration, with both the shade 20 and the chair 30 in their closed positions. Left and right straps 46*a* and 46*b* are provided in the preferred embodiment, affixed to the side of the back rest distal the seat, to allow a user to carry the entire system as a backpack. It will be appreciated by those of skill in the art that the left and right straps 46*a* and 46*b* could be affixed to the chair in a number of ways to achieve the same function.

If straps 46*a* and 46*b* are attached to the side of the back rest distal the seat, a pouch 48 may be attached to or formed from the seat distal the back rest for additional storage space. Additional functionality may be provided to the system by affixing a spritzer bottle 50 to the system. A spritzer bottle of the prior art typically includes a container, an integral pump and a coiled extension tube having a atomization nozzle 54. The user pressurizes water or other liquid stored the spritzer bottle, then places the nozzle at a desired location to enjoy a mist of humidified or evaporatively cooled air when either using the as a backpack with the chair in the closed position, or in the open, position. The nozzle typically includes a clip to secure the nozzle to the desired location on the user or the chair.

In this embodiment a collapsible lounge chair 20 is used whose tubing forming the seat 31 and arm rest 33 portions, when the chair 30 is in the closed position, extend at their furthest protruding portions 57 and 58, to be substantially the same distance from a user when the system is carried as a backpack. The furthest projecting portions each are therefore substantially the same, shown as dotted line $T_1$-$T_2$. This area 60 may be used for additional storage, such as an ice chest, a CD compartment, etc. and this construction acts as a framework to keep the storage space away from the ground when the chair is in use in the open position.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. A shade adapted to be used with a chair having a seat, comprising:

a ring made of spring material having a membrane attached to and disposed within the ring, where the ring may be moved between an open position and a closed position under spring tension and at least two parts of the ring are adapted to be attached to a chair having a seat to cover at least a portion of the seat of the chair, wherein the ring is tensioned to retain the attachments to the chair, and where the attachments are parts of the ring being formed to be mated directly to the chair while in the open position to cover the portion of the seat of the chair.

2. The shade of claim 1 where the membrane further has a flap or screen incorporated into the membrane.

3. The shade of claim 1, wherein the shade further comprises a front end having one or more cords adapted to be affixed to the chair, and a rear end, adapted to be affixed to the chair such that the one or more cords may be cinched to the chair so that the shade bends to cover at least a portion of the seat of the chair.

4. The shade of claim 1, where one part of the ring is formed to be directly mated to the seat, a backrest or to an armrest of the chair.

5. The shade of claim 4, further comprising a system including a chair having a seat and a backrest or armrests wherein the chair backrest or the armrests of the chair are adjustably attached to the seat to allow the chair to be moved from a first open position to a second collapsed position and the chair further has left and right straps affixed to the chair that are adapted to allow a user to fit his arms through the straps to carry the chair as a backpack when the chair is in the collapsed position.

6. The system of claim 5, wherein the left and right straps are affixed to a first side of the chair when it is in the collapsed position and a pouch is affixed to a second side of the chair distal the first.

7. The system of claim 6, wherein the pouch is an ice chest.

8. The system of claim 5, wherein a spritzer bottle is affixed to the system.

9. The system of claim 4 wherein the armrests are made from tubing and the seat is made from tubing with a membrane affixed to the tubing and wherein the tubing of the seat and the armrests of the chair, when the chair is in the collapsed position, extend at their furthest protruding portions to be substantially the same distance from a user when the system is carried as a backpack.

10. A system for a shade adapted to be used with a chair having a seat, comprising:

a shade comprising a ring made of spring material having a membrane attached to and disposed within the ring, where the ring may he moved between an open position and a closed position under spring tension and is adapted to be affixed to a chair when in the open position to cover at least a portion of the seat of the chair, and the chair has a backrest and the shade has a front end, the front end having one or more cords adapted to be affixed to the chair, and a rear end that has a fastener adapted to be attached to the chair, whereby when the fastener is attached to the backrest of the chair and bent over the backrest in the direction of the seat, the one or more cords may be cinched to the chair so that the shade bends to cover at least a portion of the seat of the chair.

11. The system of claim 10, further having a support band affixed to the backrest of the chair and an elevating support affixed to the backrest of the chair or the support band, wherein the elevating support adjustably extends upwardly from the top of the backrest, whereby when the shade is bent in the direction of over the backrest the elevating support will interfere with the shade to raise the rear portion of the shade higher than the backrest.

12. The system of claim 11, wherein the support band is affixed as a loop over the backrest and supports the elevating support member by having left sleeve and right sleeve, the elevating support member comprises left and right support poles that may be inserted in the sleeves and adjustably extended upwardly to raise the shade.

13. The system of claim 11, wherein the shade is of sufficiently reduced size in the closed position to be placed between the support band and the backrest for storage.

14. The system of claim 11, wherein the fastener is a clip and the clip may be passed between the backrest and the support band and affixed to the chair.

15. The system of claim 10, wherein the chair further has left and fight armrests positioned on each side of the seat substantially perpendicular to the backrest, the one or more cords are a left cord and a right cord, and the left cord is affixed to the left armrest and the fight cord is affixed to the right armrest.

16. The system of claim 10, wherein the seat and the backrest of the chair are adjustably attached to allow the chair to be moved from a first open position to a second collapsed position.

17. The system of claim 16 where the chair further includes armrests, and the armrests are made from tubing and the seat is made from tubing with a membrane and wherein the tubing of the seat and the armrests of the chair, when the chair is in the closed position, extend at their furthest protruding portions to be substantially the same distance from a user when the system is carried as a backpack.

18. A shade adapted to be used with a chair having a seat and a backrest, comprising:

a shade comprising a ring made of spring material having a membrane attached to and disposed within the ring, where the ring may be moved between an open position and a closed position under spring tension and is adapted to be affixed to a chair when in the open position to cover at least a portion of the seat of the chair, the shade has a front end, the front end having one or more cords adapted to be affixed to the chair, and a rear end that has a fastener adapted to be attached to the chair, whereby when the fastener is attached to the chair and bent over the backrest in the direction of the seat, the one or more cords may be cinched to the chair so that the shade bends to cover at least a portion of the seat of the chair.

19. The shade of claim 18, further having an elevating support affixed to the backrest of the chair, wherein the elevating support adjustably extends upwardly from the top of the backrest, whereby when the shade is bent in the direction of over the backrest the elevating support will interfere with the shade to raise the rear portion of the shade higher than the backrest.

20. The shade of claim 19, wherein the one or more cords are a left cord and a right cord, the shade is affixed to a chair having left and light armrests positioned on each side of the seat substantially perpendicular to the backrest, the left cord is adapted to be affixed to the left armrest and the right cord is adapted to be affixed to the right armrest.

21. The shade of claim 19, wherein the elevating support is affixed to the backrest with a support band, wherein the support hand is affixed as a loop over the backrest and supports the elevating support member by having left sleeve and right sleeves, the elevating support member comprises left and right support poles that may be inserted in the sleeves and adjustably extended upwardly to raise the shade.

22. The shade of claim 21, wherein the shade is of sufficiently reduced size in the closed position to be placed between the support band and the backrest for storage.

23. The shade of claim 21, wherein the fastener is a clip and the clip may be passed between the backrest and the support band and affixed to the chair.

24. A method for using a collapsible sun shade adapted to be used with a chair having a seat, comprising the steps of:

providing a shade comprising a ring made of spring material having a membrane attached to and disposed within the ring, where the ring may be moved between an open position and a closed position under spring tension and at least two parts of the ring are adapted to be attached to a chair when in the open position, opening the shade and affixing the shade to the chair to cover at least a portion of the seat of the chair wherein the ring is tensioned to retain the attachments to the chair, and the attachments are the ring being formed to be mated directly to the chair, and further including the additional steps of bending the shade while in the open position to cover at least a portion of the seat of the chair and mating the shade to the chair.

25. A method for using a collapsible sun shade system adapted to be used with a chair having a seat and backrest, comprising the steps of:

providing a shade comprising a ring made of spring material having a membrane attached to and disposed within the ring, where the ring may be moved between an open position and a closed position under spring tension and is adapted to be affixed to a chair when in the open position, opening the shade and affixing the shade at least at one point on the shade directly to the chair to cover at least a portion of the seat of the chair by bending the shade while in the open position to cover at least a portion of the seat portion of the chair attaching a first end of the shade to the area of the backrest of the chair, bending the shade over the backrest in the direction of the seat, connecting a second end of the shade to the chair with at least one cord so that the shade bends to cover at least a portion of the seat of the chair.

26. The method of claim 25, further having an elevating support affixed to the backrest of the chair that adjustably extends upwardly from the top of the backrest, further including the step of raising the elevating support whereby when the shade is bent in the direction of over the backrest the elevating support will interfere with the shade to raise the rear portion of the shade higher than the backrest.

27. The method of claim 26, wherein the seat and the backrest portions of the chair are adjustably attached to allow the chair to be moved from a first open position to a second collapsed position.

28. The method of claim 27, wherein the chair further has left and right straps affixed to the chair that are adapted to allow a user to fit his arms through the straps to carry the chair as a backpack when the chair is in the closed position, further including the step of carrying the system as a backpack.

29. The method of claim 28 wherein the seat and backrest include tubing and wherein the tubing of the seat and the backrest of the chair, when the chair is in the closed position, extend at their furthest protruding portions to be substantially the same distance from a user when the system is carried as a backpack, further including the step of placing the system on the ground and resting on the furthest protruding portions.

30. A method for using a collapsible sun shade adapted to be used with a chair having a seat and backrest, comprising the steps of:

providing a shade comprising a ring made of spring material having a membrane attached to and disposed within the ring, where the ring may be moved from an open position to a closed position under increasing spring tension and is adapted to be affixed to a chair when in the open position, opening the shade and affixing the shade at least at one point on the shade directly to the chair to cover at least a portion of the seat of the chair;

bending the shade while in the open position to cover at least a portion of the seat portion of the chair by attaching a first end of the shade to the area of the backrest of the chair, to allow the shade to be bent over the backrest in the direction of the seat, connecting a second end of the shade to the chair with at least one cord so that the shade bends to cover at least a portion of the seat of the chair.

31. The method of claim 30, further having an elevating support affixed to the backrest of the chair that adjustably extends upwardly from the top of the backrest, and futher including the step of raising the elevating support whereby when the shade is bent in the direction of over the backrest the elevating support will interfere with the shade to raise the rear portion of the shade higher than the backrest.

* * * * *